United States Patent [19]

Cappelli

[11] 4,434,540

[45] Mar. 6, 1984

[54] PROCESS FOR REPAIRING OR MODIFYING REFRACTORY PLATES OF LADLE CASTING CASSETTES

[75] Inventor: Romano Cappelli, Milan, Italy

[73] Assignee: USS Engineers and Consultants, Inc., Pittsburgh, Pa.

[21] Appl. No.: 308,733

[22] Filed: Oct. 5, 1981

[30] Foreign Application Priority Data

Aug. 7, 1981 [IT] Italy ..... 23358 A/80

[51] Int. Cl.[3] ..... B22D 11/10

[52] U.S. Cl. ..... 29/402.11; 164/438

[58] Field of Search ..... 29/527.2, 527.4, 426.2, 29/402.11; 266/271; 164/437, 438

[56] References Cited

U.S. PATENT DOCUMENTS

| | | | |
|---|---|---|---|
| 3,604,598 | 9/1971 | Kappmeyer et al. | 164/437 |
| 3,727,805 | 4/1973 | Shapland | 164/437 |
| 4,270,595 | 6/1981 | Coward | 164/437 |

FOREIGN PATENT DOCUMENTS

| | | | |
|---|---|---|---|
| 2616685 | 12/1976 | Fed. Rep. of Germany | 164/437 |
| 2064123 | 7/1971 | France | 164/438 |
| 2250594 | 6/1975 | France | 164/437 |

*Primary Examiner*—Howard N. Goldberg
*Assistant Examiner*—V. K. Rising
*Attorney, Agent, or Firm*—John F. Carney

[57] ABSTRACT

Techniques are disclosed for renovating sliding gate valve plates or for adapting conventional plates for use with problem-beset metals. Stationary plates (1) have their orifices (2) bored out to downwardly-tapering form and correspondingly tapered prefabricated refractory insert rings (3) are then cemented in place, the rings having axial depths equal to the plate thicknesses. An orificed plate (7) furnished with an integral depending nozzle (12) has its flow passage (13) bored out such that an upper bore portion extending through the plate (7) and part way along the nozzle (12) is transversely larger than the following downstream bore portion. A prefabricated refractory insert ring (9) is cemented into the upper bore portion, ring (9) being substantially as deep axially as the said bore portion. The downstream bore portion is lined with cementitious, metal-reinforced material (14). Materials for the insert rings (3, 9) and cementitious lining (14) are chosen to suit the pouring conditions and metals to be poured.

6 Claims, 3 Drawing Figures

PROCESS FOR REPAIRING OR MODIFYING REFRACTORY PLATES OF LADLE CASTING CASSETTES

BACKGROUND OF THE INVENTION

The present invention relates to methods for the renovation or adaptation of refractory valve plates used in slide gate valves for casing ladles or tundishes for controlling molten metal pouring.

Various methods are known for repairing valve plates, according to which there are inserted into the bores of the worn plates annular parts which have exactly the same thickness as the plates themselves. For valve plates having an integral "nose" or nozzle, it is known for the bore in the latter to be filled with a cement-like filling compound.

Ring-shaped inserts which have been used in prior art methods have comprised two cylindrical portions having different outside diameters, the portion having the larger outside diameter being the upper part of the ring insert.

The known prior art methods have disadvantages, the most serious of which will be now mentioned. Firstly, the ring insert for a stationary plate can extend downwardly therefrom and press on the movable plate. Secondly, the upper part of the ring insert for the stationary plate is very frequently oversized, so that the periphery of the ring insert is undesirably close to the annular recess provided, in the upper surface of the stationary plate, for sealing engagement with a refractory discharge outlet member of the associated pouring vessel. This results in the plate area between the new ring insert and the recess being considerably reduced, which may lead to leakage of molten metal.

For the movable plates, the disadvantage of a ring-shaped insert having a length equal to the plate thickness consists in that the flowing metal can seep between the lower end of the ring insert and the abutting face of the cement lining of the "nose", and thus along the contact surface between the plate and the "nose". Such may happen particularly when metal is tapped under throttling conditions with the valve only partly open, when the metal flow will possess a horizontal flow component.

The cementitious compound used for the lining of the "nose" of the movable plate is a refractory material, whose poor elasticity may lead to crack formation in the surface as well as in the body of the lining.

Valve plate repair techniques disclosed herein can equally well be employed for adapting conventional valve plates to suit them for use with special steels which may give rise to difficulties when pouring through conventional valve plates.

SUMMARY OF THE INVENTION

The present invention aims, inter alia, to provide a method of renovating or adapting the valve plates, both stationary and movable, of sliding gate valves, which method avoids the disadvantages of the prior art discussed above.

According to one aspect of the present invention there is provided a method of renovating or adapting a valve plate set of a sliding gate valve for use in controlling molten metal flow, the plate set including a stationary, orificed upper plate and an orificed lower plate furnished with an integral, depending discharge nozzle, the method including the steps of:

(a) boring out the stationary plate orifice to form a downwardly-tapering opening and securing a prefabricated refractory insert ring in the resulting opening, the ring being tapered to match the tapering opening and having an axial length equal to the thickness of the stationary plate;

(b) boring out the flow passage which extends through the lower plate and its integral nozzle to remove areas of wear and to form a stepped bore, a larger diameter portion of said bore piercing the plate and extending part way along the nozzle, while the smaller diameter portion extends through the remainder of the nozzle;

(c) securing a prefabricated refractory insert ring in the larger bore portion, the ring having an axial length greater than the plate thickness; and (d) positioning an elongated tubular former concentrically inside the smaller bore portion and filling the space between the former and the confronting inside wall of the nozzle with cementitious material to form a nozzle liner, the former having an outer diameter enabling it to fit snugly into the insert ring in the larger bore portion.

According to another aspect of the invention, there is provided a method of renovating or adapting an orificed lower valve plate of a sliding gate valve for use in controlling molten metal flow, the plate being furnished with an integral, depending discharge nozzle, wherein the method includes the steps of:

(a) boring out the flow passage which extends through the lower plate and its integral nozzle to remove areas of wear and to form a stepped bore, a larger diameter portion of said bore piercing the plate and extending part way along the nozzle, while the smaller diameter portion extends through the remainder of the nozzle;

(b) securing a prefabricated refractory insert ring in the larger bore portion, the ring having an axial length greater than the plate thickness; and (c) positioning an elongated tubular former concentrically inside the smaller bore portion and filling the space between the former and the confronting inside wall of the nozzle with cementitious material to form a nozzle liner, the former having an outer diameter enabling it to fit snugly into the insert ring in the larger bore portion.

According to a further aspect of the invention, there is provided a method of renovating or adapting a stationary, orificed upper valve plate of a sliding gate valve for use in controlling molten metal flow, the plate being held in a metal can or tray, and the method including the steps of:

(a) checking the can or tray for unevenness or distortion;

(b) eradicating any such unevenness or distortion by a pressing operation; and (c) boring out the plate orifice to form a downwardly-tapering opening and securing a pre-fabricated refractory insert ring in the resulting opening, the ring being tapered to match the tapering opening and having an axial length equal to the thickness of the stationary plate.

The invention embraces valve plates when renovated or adapted by the methods according to the invention.

Initial preparation of used valve plates may involve removal of adhering metal and slag.

Then, the evenness of the metal cans containing the plates may be checked and, if necessary, rectified by a pressing operation.

Sliding surfaces of the plates can be repaired as necessary with refractory material; suitable patching compositions are already known.

Finally, the repaired parts can be pre-dried, after-treated, dried again, and if desired tarred and graphited.

Further details of the present invention are now given by way of illustrative example in the following description.

Turning first to the stationary valve plate of a sliding gate valve set, the pour opening in the stationary plate is bored out so as to taper conically in the down-stream flow direction. For this tapered opening, a correspondingly tapered ring insert is required, its internal diameter being equal to the diameter of the original flow opening in the plate, although it could differ.

The outer surface of the ring insert should have the same conical taper as the conically-bored opening, but its dimensions are such that a gap of approximately one millimeter is left between the ring and the plate opening.

The opening in the stationary plate is bored to a dimension which is such that a distance of at least 2 mm is kept between the tapered opening and the ring-shaped recess, mentioned earlier, in the upper plate surface.

The passage opening in the movable plate and in its "nose" can be bored out to the same diameter, but preferably the movable plate and nose are counterbored to provide a larger bore in the plate per se and a smaller bore in the "nose". The larger bore should be carried into the nose.

The ring insert for the movable plate usually has the same inside diameter as the original plate orifice, though it could differ.

This ring insert is longer than the movable plate is thick and thus overlaps the contact line between the movable plate and its nose, the insert extending part way down the nose.

The outside diameter of the ring insert is approximately two millimeters smaller than the corresponding diameter of the receiving opening bored therefor in the movable plate and in its nose.

When the opening in the movable plate and in its nose is bored, care must be taken that the inner wall of the nose remains thick enough to withstand possible seepage of molten metal into the joint between the lower end face of the ring insert and the upper edge of a sleeve-shaped lining of the nose.

The thickness of the refractory wall of the nose should preferably not be less than 3 mm.

The ring inserts should be produced from a refractory material whose physical and mechanical characteristics are at least equal to those of the corresponding plate material.

In order to renew the opening in the nose of the movable plate downstream of the inert thereof, a tube is used whose outside diameter corresponds to the required internal diameter of the nose. The space between the tube and the bored out nose is filled with a refractory type of cement by the casting or ramming methods.

The type of cement used for this purpose also must have characteristics comparable with the material of the nose, that is to say it must be suitable for use in contact with the metal to be cast. Advantageously, the cement mixture with which the space between the tube and the bore is to be filled contains reinforcing strands or needles e.g. in stainless steel which are 0.2 to 5 mm thick and are not longer than the thickness of the required sleeve-shaped lining of the nose.

The weight proportion of the steel needles may range from 2% to 20% of the total weight of the filling, preferably from 8% to 15%.

The main or sliding surfaces of both plates should also be repaired, as necessary, with a refractory cement which, after drying, has a high strength against mechanical stresses, as well as a good resistance to abrasion, erosion and to chemical agents at a high temperature. When the cement coating has set, it is ground and treated as usual for the original plates.

Some movable plates have noses exhibiting small extensions which project from the metal cans or sleeves encasing the nozzles. Such an extension is so shaped that it mates with a protective tube which isolates the molten metal stream from the atmosphere as the metal is teemed into a receiving vessel.

In applying the present invention to such plates, the extension of the nose is first completely removed. Then, onto the metal sleeve another metal housing is welded, the latter being as long as the original extension. Now it is possible with the aid of a tube or former whose outside diameter corresponds to the required inside opening diameter completely to fill with refractory cement the space between the internal wall of the nose and the tube or between the tube and the metal housing extension. The refractory cement filling can be introduced by the casting or ramming methods.

The technique just described may also be used to adapt new plates if the quality of the steel necessitates refractory materials of a special type which are different from the materials conventionally used for the production of refractory plates.

By following the teaching of this invention, molten metal e.g. steel will in fact only come into contact with refractory material of a suitable type, that is to say a material which withstands both chemical stressing at a high temperature and the friction or erosion caused by the flowing metal. The refractory materials can be tailored to the exact steel to be poured. Thus, materials can be chosen for avoiding deposition, caused by eutectic formation, which reduces the opening cross section.

The advantages of this invention include from the following.

Thanks to the downwardly conically tapering ring insert for the stationary plate and to the correspondingly shaped opening therefor, thermal expansion and displacement of the insert is in the upward direction rather than downwardly against the movable plate. Thus a potential source of leakage is avoided.

Cement for fastening the ring inserts in place absorbs radial expansion of the ring inserts.

The presence of stainless steel needles in the refractory cement mixture for the filling of the nose imparts to the sleeve-shaped nose lining sufficient elasticity to prevent the formation of surface and internal cracks in the lining during casting.

Thanks to the ring insert in the movable plate being longer than the thickness of the plate, molten metal is prevented from seeping between the plate and nose.

The material strength between the casting opening in the stationary plate and the ring-shaped recess in its surface ensures an adequate mechanical strength of the crown and thus the function of the original flow trough system.

If the evenness of the metal cans is checked and remedied, and surface defects in the refractory plates are repaired, the renovated plates will offer maximum reliability and freedom from leakage.

Advantageously the tube or former around which the nose liner is formed is perforated to allow the water in the cement mixture more easily to evaporate before the tube is removed. Uniform hardening of the sleeve-shaped lining is also facilitated.

BRIEF DESCRIPTION OF THE DRAWINGS

To provide a better understanding of this invention, two applications will now be described by way of example, reference to be made to the accompanying drawings, in which.

DESCRIPTION OF THE PREFERRED EMBODIMENTS

After any metal and slag particles which may be adhering to the plates have been removed, first the evenness of the horizontal surfaces of the metal boxes 6 and 15 of the stationary plate 1 and the movable plate 7 are checked and, if necessary, rectified by pressing.

Figure 1:
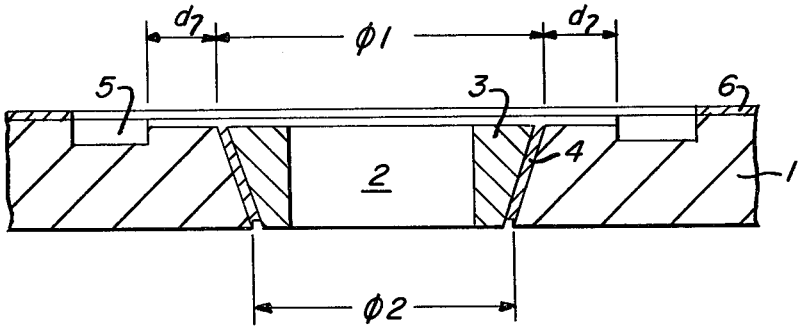
FIG. 1 is a vertical section through a stationary valve plate.

Subsequently, any defects in the sliding surfaces of the plates are repaired by patching cement. Next, the opening in the stationary plate 1 is conically bored, as shown in FIG. 1.

The upper diameter $\phi 1$ is larger than the lower diameter $\phi 2$, the cone angle being at least 5°.

The diameter $\phi 1$ has been chosen so that the distance d between the upper edge of the opening 2 and the internal edge of the ring-shaped recess 5 is at least three millimeters.

The ring insert 3, of a suitable refractory material, has the same depth as the plate thickness in the zone of the opening 2, and has a bore defining a flow orifice equal to the diameter of the opening originally in the plate. The ring insert has the same taper as that of the opening bored in the plate 1.

The opening and insert are so dimensioned that between the inner face of the opening 2 and the outer face of the ring insert 3 there is a gap of oone millimeter for cement 4 to fasten the insert in position.

Figure 2:
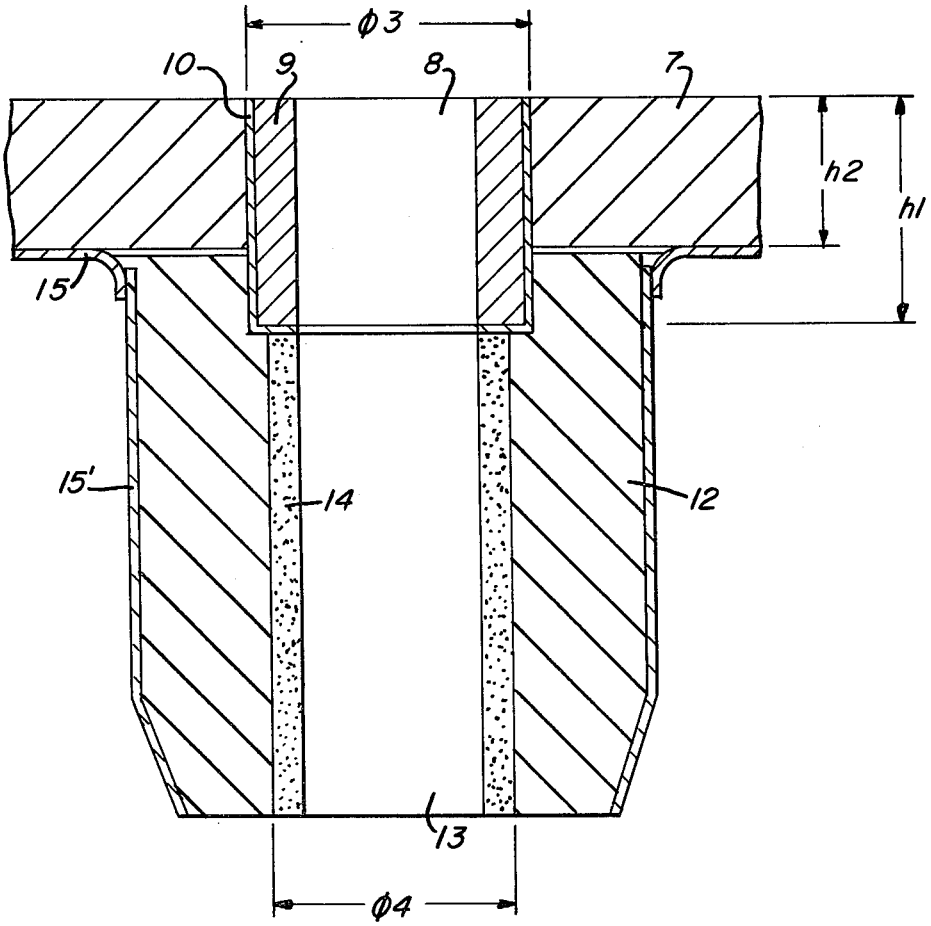
FIG. 2 is a vertical section through a movable plate having an integral nose or collector nozzle.

The opening 8 in the movable plate 7 and in the upper part of the nose, which is shown in FIG. 2, is bored out to the diameter $\phi 3$ for a distance h1 from the sliding surface of the plate 7 while the remaining lower part of the nose is bored out to the diameter $\phi 4$ which is smaller than $\phi 3$. Distance h1 is greater than the plate thickness.

The ring insert 9 which is to be accommodated in the larger opening portion contained in the plate and the upper part of the nose, has an outside diameter two millimeters smaller than $\phi 3$. The resulting gap is filled with cement 10.

It clearly emerges from FIG. 2 that the ring insert 9 extends far beyond the contact line between the plate 7 and the nose 12, since its dimension h1 considerably exceeds the thickness h2 of the plate.

The inside diameter of the ring insert 9 has the same dimension as the opening originally in the plate 7.

The sleeve 14, with which the opening 13 of the nose 12 is lined, is made of a cementitious material which contains 12% by weight of very thin needles in stainless steel.

The cement mixture is pressed into the opening 13 after the ring insert 9 and the perforated tube 16 (only shown in FIG. 3) have been inserted.

The thickness of the cement lining 14 is chosen to be such that the opening defined thereby for metal flow has the same diameter as the inside diameter of the ring insert 9.

The diameter $\phi 4$ is chosen such that all the worn material is removed from the plate and the nose while leaving the wall of the nose with a thickness of 5 mm.

Figure 3:
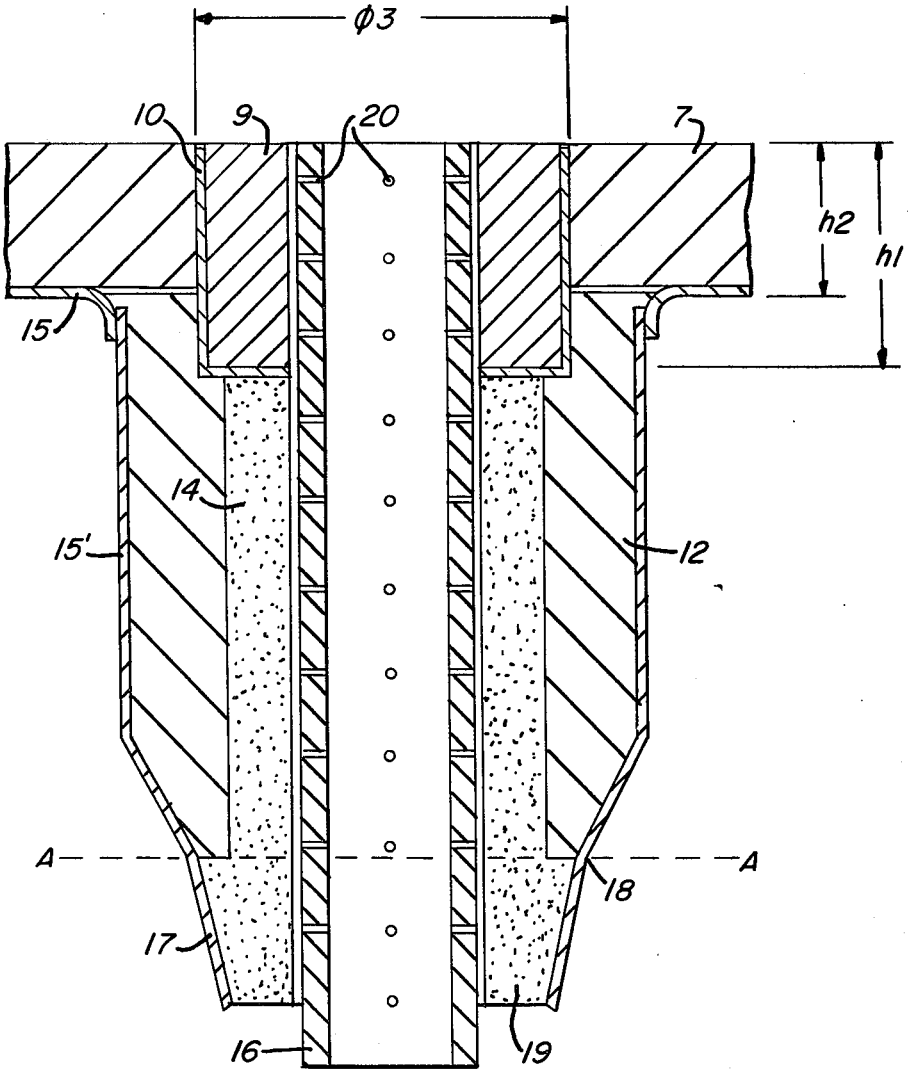
FIG. 3 is a vertical section through a second movable plate having an integral nozzle for mating with an elongated pouring tube.

In FIG. 3, there is shown a movable plate 7 whose nose originally had a refractory material extension 19 which occupied the entire surface beneath the line A—A.

The ring isert 9 of the height h1, which is larger than the thickness h2 of the plate 7, is placed into the opening having the diameter $\phi 3$ of the plate and into the upper part of the nose.

After the original refractory extension 19 has been removed, a metal sleeve extension 17 is secured to the lower part of the sleeve 15' by a weld 18. The sleeve extension has the same shape as the original refractory material extension.

The entire space between the perforated tube 16 and the opening of the nose as well as between the tube 16 and the sleeve extension 17 can be filled with the already-mentioned cement mixture.

What is claimed is:

1. A method of renovating a spent orificed slide gate of a sliding gate valve for use in controlling the flow of molten metal, said slide gate comprising a flat, elongated refractory plate having a sliding face on one side thereof, a flow passage through the interior portion of the plate and a refractory discharge nozzle forming an extension of said flow passage being integral with and depending from the other side of said refractory plate, said method comprising the steps of:

(a) boring said flow passage to remove areas of wear, said boring being to a greater diameter through said plate and part way along said discharge nozzle and to a smaller diameter along the remainder of said flow passage through said discharge nozzle;

(b) securing a prefabricated refractory insert ring having an axial length greater than the thickness of said plate in said greater diameter portion of said boring;

(c) positioning an elongated tubular former concentrically within said smaller diameter portion of said boring; and (d) filling the space between said former and the confronting inside wall of said smaller diameter boring portion with cementitious material to form a lining through said discharge nozzle.

2. A method according to claim 1 including the step of reenforcing the cementitious material filling said space with metallic needles.

3. For use in a sliding gate valve for teeming molten metal in which an orificed slide gate is movable with respect to a vessel pour opening, said sliding gate including a flat, elongated refractory plate having a sliding face on one side thereof and a refractory nozzle projecting from the other side thereof, a stepped bore extending continuously through said plate and nozzle, a larger diameter portion of said bore extending through said plate and part way through said refractory nozzle, and a smaller diameter portion extending through the remainder of said nozzle, a refractory insert ring having an axial length greater than the thickness of said plate fixedly received in said larger diameter portion of said bore and an annular lining of cementitious material disposed axially along the smaller diameter bore portion through said nozzle.

4. A slide plate according to claim 3 in which said cementitious material is reenforced with metallic needles.

5. A slide plate according to claim 4 in which said needles are formed of stainless steel, have a thickness in the range of 0.2 to 5 mm and have a length no greater than the radial thickness of said annular lining, said needles being about 2 to 20 percent by weight of the mixture of needles and cementitious material.

6. A slide plate according to claim 5 in which the weight percentage of the needles in said mixture is in the range of about 8 to 15 percent.

* * * * *